US007466267B2

(12) United States Patent
Ishikura

(10) Patent No.: US 7,466,267 B2
(45) Date of Patent: Dec. 16, 2008

(54) ANTENNA DEVICE AND ELECTRONIC APPARATUS

(75) Inventor: Hiroshi Ishikura, Hirakata (JP)

(73) Assignee: Digital Electronics Corporation, Osaka (JP)

( * ) Notice: Subject to any disclaimer, the term of this patent is extended or adjusted under 35 U.S.C. 154(b) by 299 days.

(21) Appl. No.: 11/392,643

(22) Filed: Mar. 30, 2006

(65) Prior Publication Data

US 2006/0227053 A1 Oct. 12, 2006

(30) Foreign Application Priority Data

Mar. 31, 2005 (JP) ..... 2005-102759

(51) Int. Cl.
*H01Q 1/38* (2006.01)

(52) U.S. Cl. ..... 343/700 MS; 343/702

(58) Field of Classification Search ..... 343/700 MS, 343/702

See application file for complete search history.

(56) References Cited

U.S. PATENT DOCUMENTS 4,356,492 A 10/1982 Kaloi
5,050,295 A * 9/1991 Sullivan et al. ..... 29/830
5,410,322 A * 4/1995 Sonoda ..... 343/700 MS
5,420,596 A * 5/1995 Burrell et al. ..... 343/700 MS
6,157,348 A * 12/2000 Openlander ..... 343/846
6,456,250 B1 * 9/2002 Ying et al. ..... 343/702
2002/0047038 A1 4/2002 Sangawa et al.

FOREIGN PATENT DOCUMENTS

EP 1 168 491 A1 1/2002
JP 08-321718 12/1996

OTHER PUBLICATIONS

European Search Report mailed Jul. 12, 2006 for Corresponding European patent application No. 06006311.2.

* cited by examiner

*Primary Examiner*—HoangAnh T Le
(74) *Attorney, Agent, or Firm*—Harness, Dickey & Pierce, PLC

(57) ABSTRACT

An antenna device includes a dielectric substrate, a ground plane, a pair of antenna elements, a feeding section, and a pair of transmission lines. The ground plane is formed on a surface of the dielectric substrate. The antenna elements are flat, have different resonant frequencies, are formed on another surface of the dielectric substrate, and respectively have ends electrically connected to the ground plane. The feeding section feeds power to each of the antenna elements. The transmission lines carry out impedance conversion such that parts of the transmission lines which are connected to the antenna elements have impedances matching input impedances of the antenna elements, respectively, and such that part of the feeding section which is fed with the power has an impedance matching an impedance of the feeding section.

12 Claims, 15 Drawing Sheets

ANTENNA DEVICE AND ELECTRONIC APPARATUS

This Nonprovisional application claims priority under 35 U.S.C. § 119(a) on Patent Application No. 102759/2005 filed in Japan on Mar. 31, 2005, the entire contents of which are hereby incorporated by reference.

FIELD OF THE INVENTION

The present invention relates to (i) a flat antenna device including an antenna element for use in wireless communication and (ii) an electronic apparatus in which the antenna device is installed.

BACKGROUND OF THE INVENTION

A conventional flat antenna remarkably deteriorates in its antenna characteristics when installed in or near a structure made of a material such as a high dielectric constant material or a metallic material, and accordingly becomes unable to function as an antenna. In view of this, a thin flat antenna has been practically used whose antenna characteristics are not affected by (i) the structure in which the antenna is installed or (ii) the structure located near the antenna.

Such an antenna has an antenna element provided on a dielectric substrate obtained by providing a dielectric member on a ground plane, and is called a patch antenna. The patch antenna typically has a shape of a square, a rectangle, or a circle. The patch antenna having either the square shape or the rectangular shape has a pair of sides each of which has a length given by the following formula:

$$d=\lambda/2\sqrt{\in_{eff}} \text{ or } d=\lambda/4\sqrt{\in_{eff}}$$

where $\lambda$ is the wavelength of the operating frequency, and $\in_{eff}$ is the apparent dielectric constant of the dielectric substrate, and $1/\sqrt{\in_{eff}}$ is the wavelength shortening rate.

The half-wavelength patch antenna has one side whose length corresponds to one-half of the wavelength, and has a feeding point positioned at any point on the side, excepting the midpoint of the side. On the other hand, a quarter-wavelength patch antenna has one side which has a length corresponding to one-quarter of the wavelength and which has one end electrically connected to a ground plane. The quarter-wavelength patch antenna has a feeding point placed at any point on the side.

The input impedance of the patch antenna depends on the position of the feeding point. Therefore, the feeding point is positioned such that the desired input impedance can be obtained. See a case of the patch antenna (circular patch antenna) having the circular shape. The circular patch antenna takes the shape of a circle whose circumferential length 2 $\pi$a is given by the following formula:

$$2\pi a=1.84\lambda/\sqrt{\in_{eff}}$$

where a is the radius of the circle.

The circular patch antenna is arranged such that the center of the circle is electrically connected to the ground plane, and such that the feeding is made with respect to any point except the center. The input impedance of the circular patch antenna also depends on the position of the feeding point. Therefore, the feeding point of the circular patch antenna is positioned such that the desired input impedance can be obtained.

As described above, the shape and size of the patch antenna are determined in accordance with the operating frequency and the effective dielectric constant of the dielectric substrate. In the meanwhile, the bandwidth of the patch antenna, i.e., an important antenna characteristic of the patch antenna, is determined in accordance with the thickness and a dielectric constant of the dielectric substrate. Specifically, as the dielectric substrate is thinner and has a larger dielectric constant, the bandwidth becomes narrower. In a general case, the patch antenna has a narrow bandwidth corresponding to not more than a bandwidth of 1% to 2% with respect to the operating frequency.

An antenna device using such a patch antenna element is disclosed, for example, in Japanese Unexamined Patent Publication No. 321718/1996 (Tokukaihei 8-321718; published on Dec. 3, 1996).

The antenna device disclosed in the publication is a patch antenna arranged in the following manner. That is, a pair of antenna elements are provided on a dielectric substrate having a rear surface on which a rectangular ground plane is formed, and respectively have sides electrically connected to the ground plane. Such an antenna device adopts a structure that improves (i) the balance between the powers supplied to the two antenna elements and (ii) a frequency characteristic corresponding to change in the phase difference between the powers.

However, the size and bandwidth of the antenna device such as the flat antenna having the antenna elements provided on the dielectric substrate provided on the ground plane depends on the dielectric constant of the dielectric substrate and on the operating frequency. This greatly limits freedom in setting the size and bandwidth of the antenna device. For example, in some cases, the patch antenna is too big to be installed in an electronic device having certain size and structure.

In contrast, see an inverted F antenna. As is the case with the patch antenna, the inverted F antenna can be installed on a surface of a metal case (metal structure) of an electronic apparatus or the like. However, unlike the patch antenna, the inverted F antenna is small, and can secure a wide band. However, it is structurally impossible for the inverted F antenna to be lower (thinner) in height (thickness). Therefore, the installation of the inverted F antenna on the surface of the metal structure causes such a problem that the surface of the metal structure is disfigured.

The patch antenna can be formed so as to be thinner than the inverted F antenna. However, the antenna element needs to have a side whose length corresponds to the length obtained by multiplying one-quarter of the wavelength by the wavelength shortening rate. Accordingly, the patch antenna requires an area more than five times as large as the inverted F antenna does. For example, a patch antenna using a dielectric substrate made of a glass plate having a relative dielectric constant of 6.91 and a thickness of 1.8 mm cannot cover the frequency band defined by wireless LAN (IEEE802.11b/g) 2.45 GHz. A required bandwidth for an antenna compliant with this wireless standard is at least 100 MHz.

Further, in the antenna device described in the above publication, the two antenna elements have the same frequency characteristic so as to attain a wide band, but cannot attain a wide band sufficient for a large number of channels used in the wireless LAN or the like.

SUMMARY OF THE INVENTION

An object of the present invention is to provide an antenna structure by which a flat antenna can be designed to be smaller and to realize a wider band.

In order to attain the foregoing object, an antenna device of the present invention includes: a dielectric substrate; a ground plane, which is formed on a surface of the dielectric substrate;

a pair of antenna elements, which are flat and which have different resonant frequencies and which are formed on another surface of the dielectric substrate and which respectively have ends electrically connected to the ground plane; a feeding section for feeding power to each of the antenna elements; and a pair of transmission lines, which are connected respectively to the antenna elements and which carry out impedance conversion such that parts of the transmission lines which are connected to the antenna elements have impedances matching input impedances of the antenna elements, respectively, and such that part of the feeding section which is fed with the power has an impedance matching an impedance of the feeding section.

According to the foregoing arrangement, the antenna elements, the dielectric substrate, and the ground plane constitute a patch antenna. In addition, the antenna elements respectively have the ends electrically connected to the ground plane, so that the antenna elements and the ground plane constitute an inverted F antenna. This makes it possible to realize an antenna which has a small area but which realizes radiation efficiency equivalent to that of the patch antenna. Further, the antenna elements having different resonant frequencies are connected respectively to the transmission lines, so that the antenna elements do not affect each other but operate independently of each other.

Additional objects, features, and strengths of the present invention will be made clear by the description below. Further, the advantages of the present invention will be evident from the following explanation in reference to the drawings.

DESCRIPTION OF THE EMBODIMENTS

An embodiment of the present invention will be described below with reference to FIGS. 1 to 15.

Figure 1:
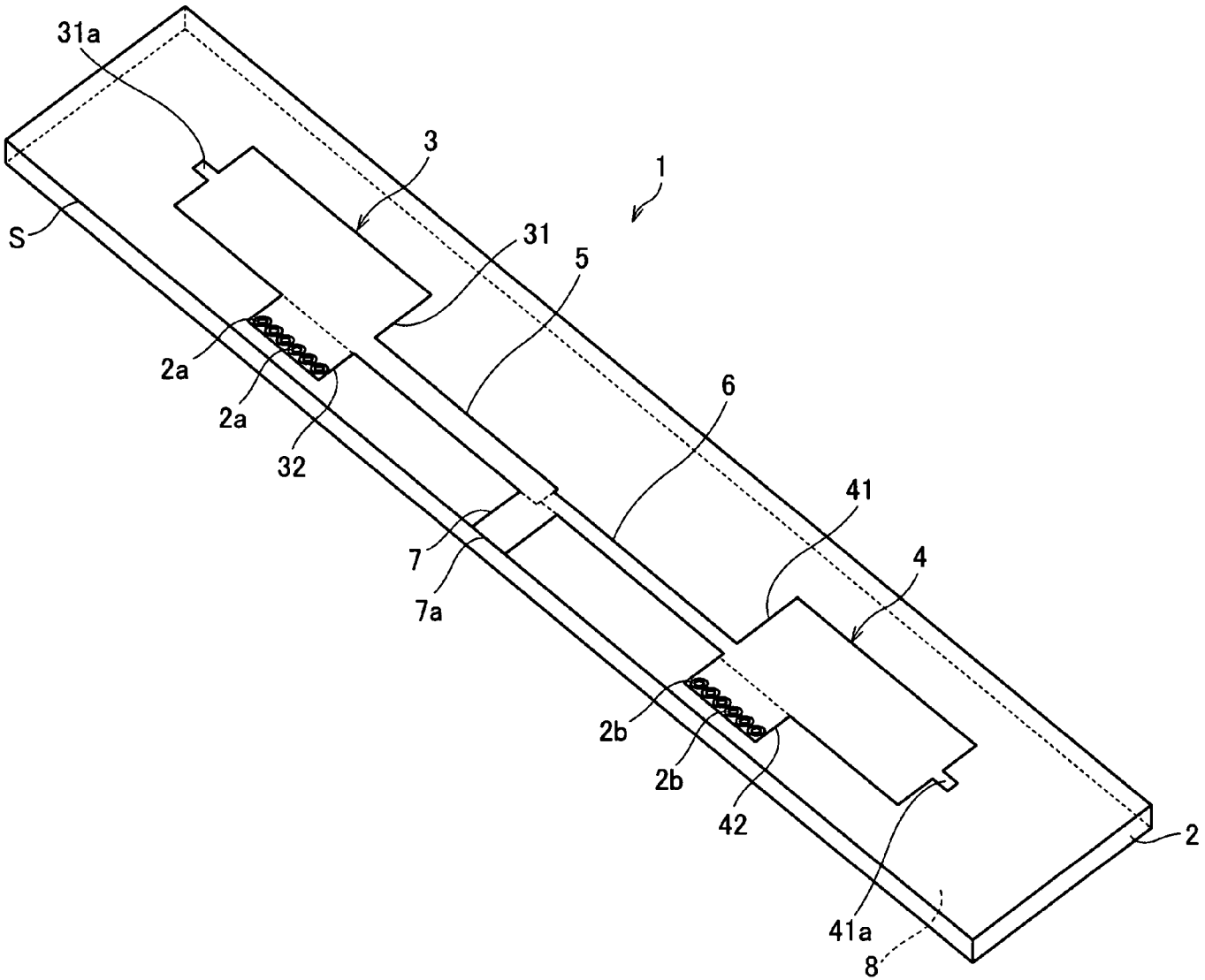
FIG. 1 is a perspective view illustrating a structure of an antenna device according to an embodiment of the present invention.

As illustrated in FIG. 1, an antenna device 1 according to the present embodiment includes a dielectric substrate 2 having a rectangular shape, antenna elements 3 and 4, transmission lines 5 and 6, a feeding section 7, and a ground plane 8. The antenna elements 3 and 4, the transmission lines 5 and 6, and the feeding section 7 are formed on one surface of the dielectric substrate 2. Each of the antenna elements 3 and 4 is made of a planar conductor. The ground plane 8 is made of a plane conductor which is uniformly formed over the other surface of the dielectric substrate 2. Each of the antenna elements 3 and 4, the transmission lines 5 and 6, the feeding section 7, and the ground plane 8 is made of a conductor sheet such as copper foil or the like.

The dielectric substrate 2 is made of epoxy resin or the like. The dielectric substrate 2 has a longer side of a length approximately corresponding to 0.7 to 0.8 times the wavelength of an operating frequency. The dielectric substrate 2 has a shorter side of a length approximately corresponding 0.09 to 0.13 times the wavelength of the operating frequency.

The antenna elements 3 and 4 are provided near both ends of the dielectric substrate 2, respectively. The antenna elements 3 and 4 are connected to each other, via the transmission lines 5 and 6 and the feeding section 7, which is provided substantially in a central portion of the dielectric substrate 2. The feeding section 7 is formed so as to extend in a width direction of the dielectric substrate 2. Specifically, the feeding section 7 extends from a longer side S, i.e., from one of the longer sides of the dielectric substrate 2, to an area near the central portion of the dielectric substrate 2. The feeding section 7 includes an end of the longer side S via which the feeding is made, such an end being hereinafter referred to as a feeding end. The feeding end includes a feeding point 7*a* to which a coaxial cable (not shown) is connected.

The transmission line 5 connects a connecting end (which is opposite to the feeding end) of the feeding section 7 to the antenna element 3. The transmission line 6 connects the connecting end of the feeding section 7 to the antenna element 4. An impedance conversion is carried out by the transmission lines 5 and 6 (i) such that part of the transmission line 5 which is connected to the connecting end has the impedance matching the input impedance of the antenna element 3, (ii) such that part of the transmission line 6 which is connected to the connecting end has the impedance matching the input impedance of the antenna element 4, and (iii) such that the feeding point 7*a* (feeding end) of the feeding section 7 which is fed with power has the impedance matching the impedance of the feeding section 7.

The antenna element 3 includes a first element section 31 and a second element section 32. Similarly, the antenna element 4 includes a first element section 41 and a second element section 42.

The first element section 31 has a shape of a rectangle whose longer sides extend in a longitudinal direction of the dielectric substrate 2. The second element section 32 has a shape of a rectangle so as to protrude toward the longer side S from the longer side, on the longer side S, of the first element section 31. An end portion of the second element section 32 is located near the longer side S. The dielectric substrate 2 includes a plurality of through-holes 2*a*. The through-holes 2*a* are formed in a line along and near the end portion of the second element section 32. The second element section 32 is electrically connected to the ground plane 8 via the through-holes 2*a*.

The first element section 41 has a shape of a rectangle whose longer sides extend in a longitudinal direction of the dielectric substrate 2. The second element section 42 has a shape of a rectangle so as to protrude toward the longer side S from the longer side, on the longer side S, of the first element section 41. An end portion of the second element section 42 is located near the longer side S. The dielectric substrate 2 includes a plurality of through-holes 2*a*. The through-holes 2*a* are formed in a line along and near the end portion of the second element section 42. The second element section 42 is electrically connected to the ground plane 8 via the through-holes 2*a*.

The antenna elements 3 and 4 have different outer dimensions so as to have different resonant frequencies. Generally, the resonant frequency of a flat antenna such as a patch antenna varies depending on an outer dimension of the flat antenna. It is possible that the antenna elements 3 and 4 respectively have different resonant frequencies by causing the first element sections 31 and 41 to have different lengths.

Figure 2:
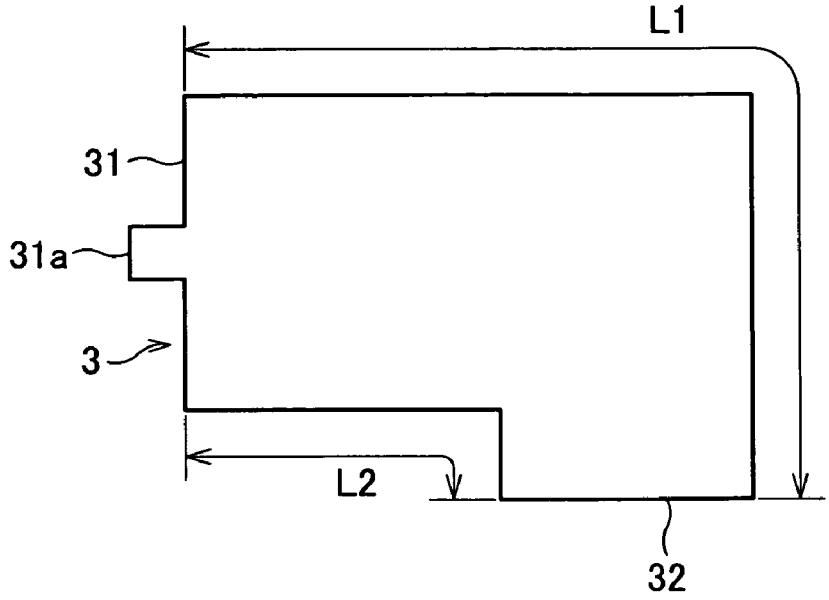
FIGS. 2(*a*) and 2(*b*) are plan views respectively illustrating the outer dimensions of two antenna elements of the antenna device.
Figure 2:
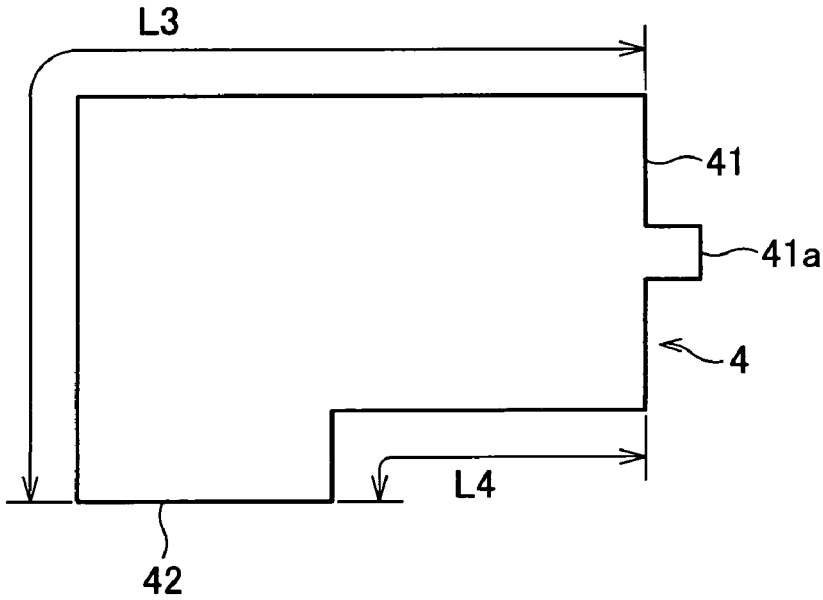

Specifically, as illustrated in FIG. 2(*a*), the wavelength λ1 of a radio wave transmitted or received by the antenna element 3 is represented by the following formula:

$$(L1+L2)/2=\lambda 1/4$$

where L1 is the length of an L-shape, i.e., the sum of (i) the length of a continued part formed by the first and second element sections 31 and 32 in the width direction of the dielectric substrate 2 and (ii) the length of the longer side of the first element section 31, and L2 is the length of an L-shape part formed by the first and second element sections 31 and 32, i.e., the sum of (a) the length of the second element section 32 in the width direction of the dielectric substrate 2 and (b) the length of the shorter one of the longer sides of the first element section 31.

On the other hand, as illustrated in FIG. 2(*b*), the wavelength of λ2 of a radio wave transmitted or received by the antenna element 4 is represented by the following formula:

$$(L3+L4)/2=\lambda 2/4$$

where L3 is the length of an L-shape, i.e., the sum of (i) the length of a continued part formed by the first and second element sections 41 and 42 in the width direction of the dielectric substrate 2 and (ii) the length of the longer side of the first element section 41, and L4 is the length of an L-shape formed the first and second element sections 41 and 42, i.e., the sum of (a) the length of the second element section 42 in the width direction of the dielectric substrate 2 and (b) the length of the shorter one of the longer sides of the first element section 41.

However, it is generally known that a change in size of a large-area section of an antenna element causes a great change in frequency. In view of this, the antenna device 1 includes the antenna elements 3 and 4 respectively having frequency adjustment tabs 31*a* and 41*a* (current path adjustment sections).

The frequency adjustment tab 31*a* is provided at an end portion of the shorter side which is opposite to the side of the first element section 31 to which the transmission line 5 is connected. The frequency adjustment tab 31*a* is provided so as to protrude in a longitudinal direction of the first element section 31, and has a shape of a square or rectangle sufficiently smaller than the first element section 31. Similarly, the frequency adjustment tab 41*a* is provided at an end portion of the shorter side which is opposite to the side of the first element section 41 to which the transmission line 6 is connected. The frequency adjustment tab 41*a* is provided so as to protrude in a longitudinal direction of the first element section 41, and has a shape of a square or rectangle sufficiently smaller than the first element section 41.

The frequency adjustment tabs 31*a* and 41*a* are formed so as to be sufficiently smaller than the first element sections 31 and 41, respectively. Therefore, a frequency change can be smaller by a change in size of the frequency adjustment tab 31*a* than by a change in size of the first element section 31. For example, a resonant frequency of the antenna element 3 changes by 100 MHz when the length of the first element section 31 is changed by 1 mm, whereas a resonant frequency of the antenna element 3 changes by 100/6 MHz (approximately 17 MHz) when the length of the frequency adjustment tab 31*a* (in the longitudinal direction of the first element section 31) is changed by 1 mm. That is, the resonant frequency change obtained by changing the length of the frequency adjustment tab 31*a* by 1 mm is ⅙ as great as that obtained by changing the length of the first element section 31 by 1 mm. Similarly, a frequency change can be smaller by a change in size of the frequency adjustment tab 41*a* than by a change in size of the first element section 41. For example, a resonant frequency of the antenna element 4 changes by 100 MHz when the length of the first element section 41 is changed by 1 mm, whereas a resonant frequency of the antenna element 4 changes by 100/6 MHz (approximately 17 MHz) when the length of the frequency adjustment tab 41*a* (in the longitudinal direction of the first element section 41) is changed by 1 mm. That is, the resonant frequency change obtained by changing the length of the frequency adjustment tab 41*a* by 1 mm is ⅙ as great as that obtained by changing the length of the first element section 41 by 1 mm. Accordingly, when the frequency adjustment tab 31*a* is formed so as to be longer than the frequency adjustment tab 41*a*, it is possible that the antenna element 3 has a resonant frequency lower than that of the antenna element 4. Thus, the frequency adjustment tabs 31*a* and 41*a* make it possible to finely adjust the resonant frequencies. Therefore, for example, it becomes possible to adjust a resonant frequency on the order of 100 MHz by changing the length of each of the first element sections 31 and 41, and to finely adjust the resonant frequency on the order of 10 MHz by changing the length of each of the frequency adjustment tabs 31*a* and 41*a*.

Figure 4:
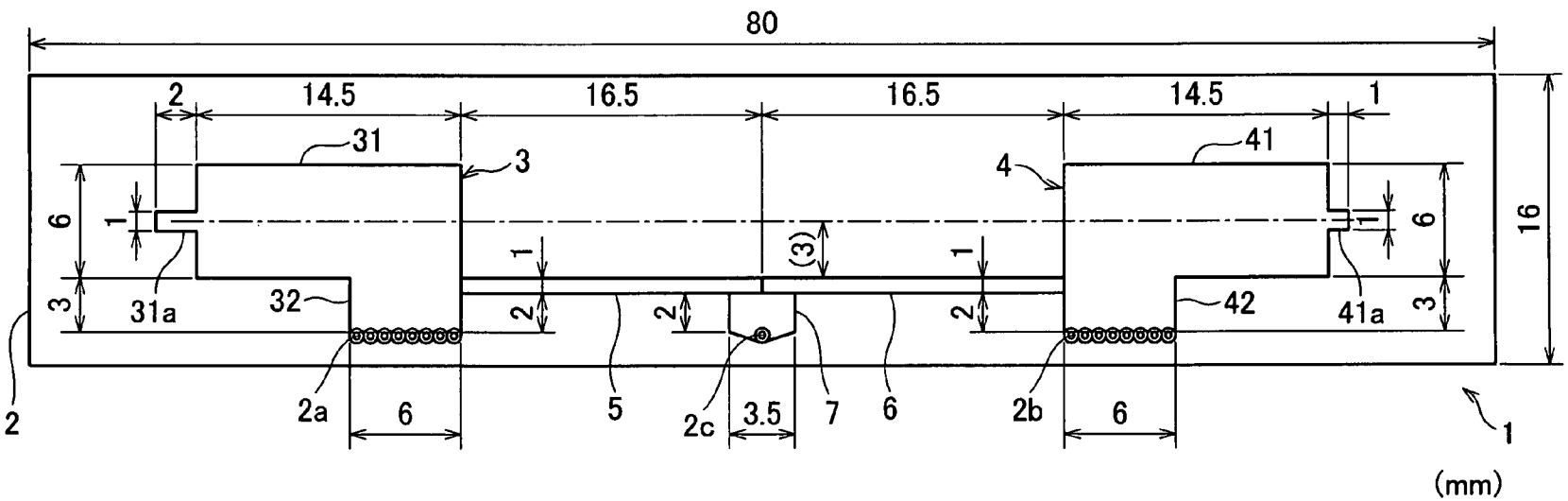
FIG. 4 is a plan view specifying the respective dimensions of components of the antenna device simulated for prediction of its antenna characteristics.

The fine adjustment of the resonant frequencies by the frequency adjustment tabs 31*a* and 41*a* is realized in the after-mentioned antenna device 1 illustrated in FIG. 4.

Note that the antenna elements 3 and 4 have different resonant frequencies, depending on (i) the size of the antenna elements 3 and 4, (ii) the relative dielectric constant of a dielectric material of which the dielectric substrate 2 is made, and/or (iii) the thickness of the dielectric substrate 2. For example, when the relative dielectric constant of the dielectric material is high, a wavelength shortening effect can be obtained in which apparent wavelengths of the conductors (antenna elements) attached firmly to the dielectric material are shortened. This makes it possible to reduce the size of the conductors. Further, the antenna elements 3 and 4 become unable to resonate when the thickness of the dielectric substrate 2 is too small.

Figure 3:
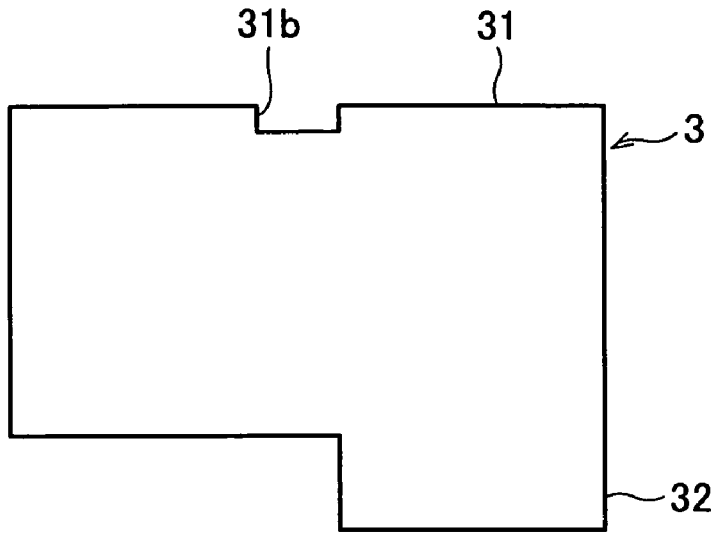
FIGS. 3(*a*) and 3(*b*) are plan views respectively illustrating structures of two notched antenna elements of the antenna device.
Figure 3:
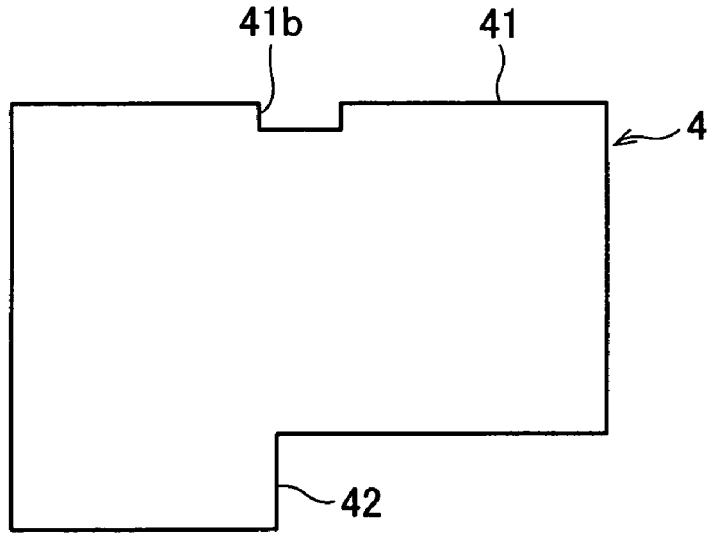

Another fine adjustment of the resonant frequencies of the antenna elements 3 and 4 can also be realized with the use of means other than the frequency adjustment tabs 31*a* and 41*a*. For example, as illustrated in FIGS. 3(*a*) and 3(*b*), the first element sections 31 and 41 can have notches 31*b* and 41*b* (current path adjustment sections), respectively. One of the longer sides of the first element section 31 includes a notch 31*b*, and one of the longer sides of the first element section 41 includes a notch 41*b*. The notches 31*b* and 41*b* bring about the same effects as the frequency adjustment tabs 31*a* and 41*a*. This arrangement makes use of the skin effect in which a high-frequency current flows near an edge portion of a conductor instead of flowing through a central portion of the conductor. Each of the notches 31*b* and 41*b* is used so as to adjust a distance the high-frequency current travels. This makes it possible to change the resonant frequencies of the antenna elements 3 and 4. Each of the frequency adjustment tabs 31*a* and 41*a* has a function of adjusting a resonant frequency in accordance with the same principle. When the notch 31*a* is formed so as to be longer (wider) than the notch 41*a*, it is possible that the antenna element 3 has a resonant frequency lower than that of the antenna element 4. That is, the frequency adjustment tabs 31*a* and 41*a* as well as the notches 31*b* and 41*b* cause the high-frequency current to flow through a current path (i.e., to travel a distance) longer, as compared with the arrangement in which no frequency adjustment tab and no notch is provided. This makes it possible to change the resonant frequencies of the antenna elements 3 and 4.

Further, the notches 31*b* and 41*b* may be replaced respectively by protrusions like the frequency adjustment tabs 31*a* and 41*a* such that the resonant frequencies are adjusted. However, when each of such protrusions has a narrow width, the high-frequency current flows along the end portion of the protrusion instead of flowing through an edge portion of the protrusion. Therefore, it is preferable that the protrusion have a greater width. In contrast, the notches 31*b* and 41*b* do not cause such inconvenience. This is because the high-frequency current does not jump across a space between both ends of each of the notches 31*b* and 41*b*, but flows along each bottom of the notches 31*b* and 41*b*.

The antenna elements 3 and 4 has different input impedances for the same frequency. Generally, impedance conversion is carried out from input impedance Za of the antenna to input impedance Zin in accordance with a characteristic impedance Zo of the quarter-wavelength transmission line, as represented by the following formula:

$$Zin=Zo^2/Za$$

Accordingly, the combined impedance Z obtained by connecting the transmission lines 5 and 6 via the feeding section 7 is represented by the following formula:

$$Z=\sqrt{(Z1^{-2}+Z2^{-2})^{-1}}$$

where Z1 is the input impedance of the transmission line 5 serving as both a quarter-wavelength transmission line and a microstrip line branching filter, and Z2 is the input impedance of the transmission line 6 serving as both a quarter-wavelength transmission line and a microstrip line branching filter.

Generally, the input impedance of the feed point 7*a* (the input impedance of the antenna device 1) is 50 Ω. Therefore, the input impedances Z1 and Z2 are set by appropriately setting the respective widths and lengths of the transmission lines 5 and 6 such that Z is 50 Ω in the foregoing formula.

The following explains the characteristics of the antenna device 1 arranged as described above.

The dimensions of the components of the antenna device 1 used for estimation of the antenna characteristics explained below are determined as illustrated in FIGS. 4 through 7.

First, the dielectric substrate 2 is made of glass epoxy having a relative dielectric constant of 4.7. As illustrated in FIG. 4, the dielectric substrate 2 has a length of 80 mm, a width of 16 mm, and a thickness of 2 mm. The dimensions of the other components are as follows. Each of the first element sections 31 and 41 has a length of 14.5 mm and a width of 6 mm. Each of the second element sections 32 and 42 has a length of 3 mm and a width of 6 mm. The frequency adjustment tab 31*a* has a length of 2 mm and a width of 1 mm. The frequency adjustment tab 41*a* has a length of 1 mm and a width of 1 mm. Each of the transmission lines 5 and 6 has a length of 16.5 mm and a width of 1 mm. The feeding section 7 has a length of 2 mm (2.5 mm when a tip thereof is included) and a width of 3.5 mm. The other dimensions are shown in FIG. 4.

Figure 5:
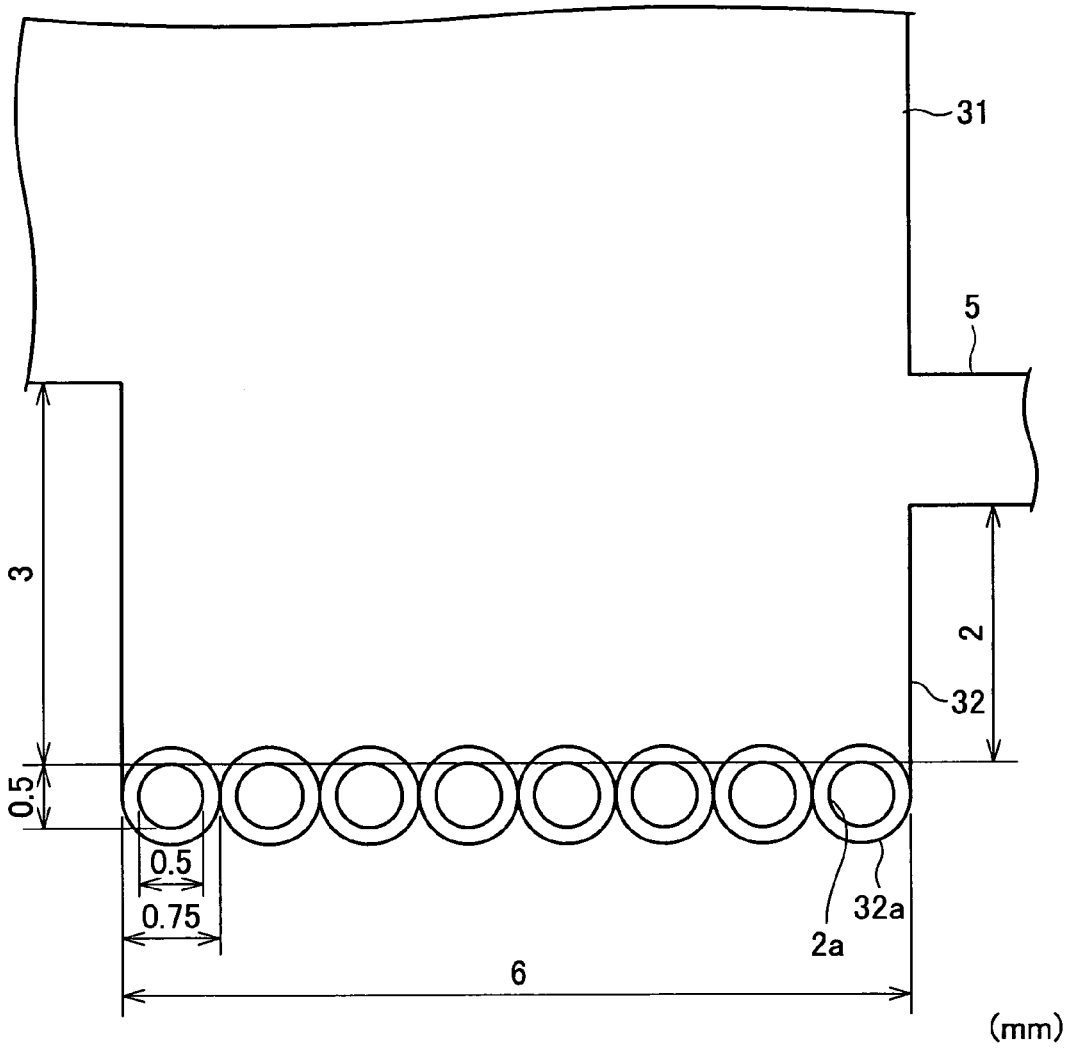
FIG. 5 is an enlarged plan view illustrating a part of the antenna device of FIG. 4.
Figure 6:
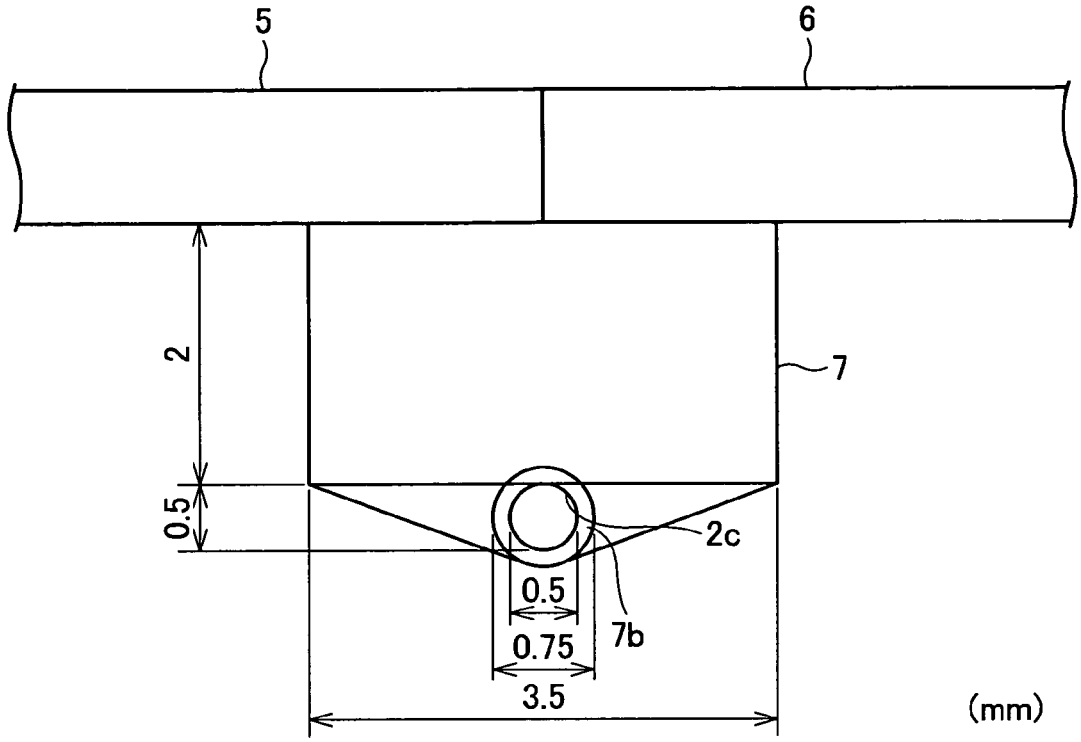
FIG. 6 is an enlarged plan view illustrating another part of the antenna device of FIG. 4.
Figure 7:
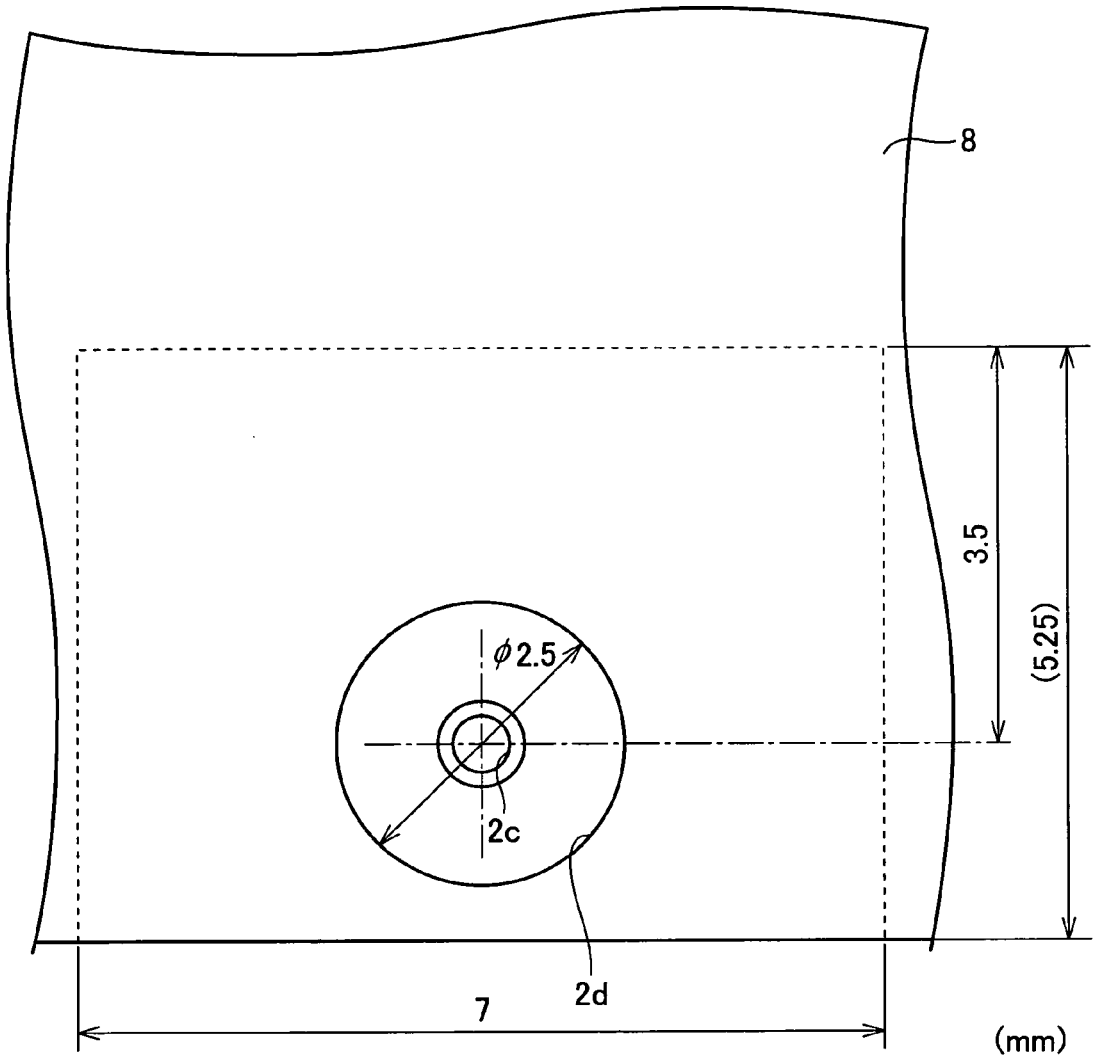
FIG. 7 is an enlarged plan view specifying the respective dimensions of components provided on the side of a ground plane of the antenna device simulated for prediction of its antenna characteristics.

Further, as illustrated in FIG. 5, each of the through-holes 2*a* formed through the second element section 32 has a diameter of 0.5 mm, and a land 32*a* provided on the second element section 32 so as to surround a mouth of the through-hole 2*a* has an outer diameter of 0.75 mm. Further, as illustrated in FIG. 6, a through-hole 2*c* formed through the dielectric substrate 2 so as to be positioned at the feed point 7*a* of the feeding section 7 has a diameter of 0.5 mm, and a land 7*b* provided so as to surround a mouth of the through-hole 2*c* has an outer diameter of 0.75 mm. Furthermore, as illustrated in FIG. 7, the dielectric substrate 2 is provided with a hole 2*d* to which a connector (MMCX connector manufactured by Telegartner Inc.; Part No. J01341A0081) of the coaxial cable is connected. The hole 2*d* is provided on the side of the ground plane 8 so as to surround the through-hole 2*c*. The hole 2*d* has a diameter of 2.5 mm. Further, formed in a predetermined area (indicated by the dotted line in FIG. 7) having a shape of a square or rectangle surrounding the hole 2*d* is a connector-soldering land having dimensions 7 mm×5.25 mm. The distance in the width direction of the ground plane 8 is set at 3.5 mm between (i) an inner end of the connector-soldering land and (ii) the center of the through-hole 2*c*. The "inner end" of the connector-soldering land refers to a portion facing the central portion of the ground plane 8.

The antenna device 1 was simulated with the use of an electromagnetic field simulator adopting the moment method. As a result, good antenna characteristics were estimated.

Figure 8:
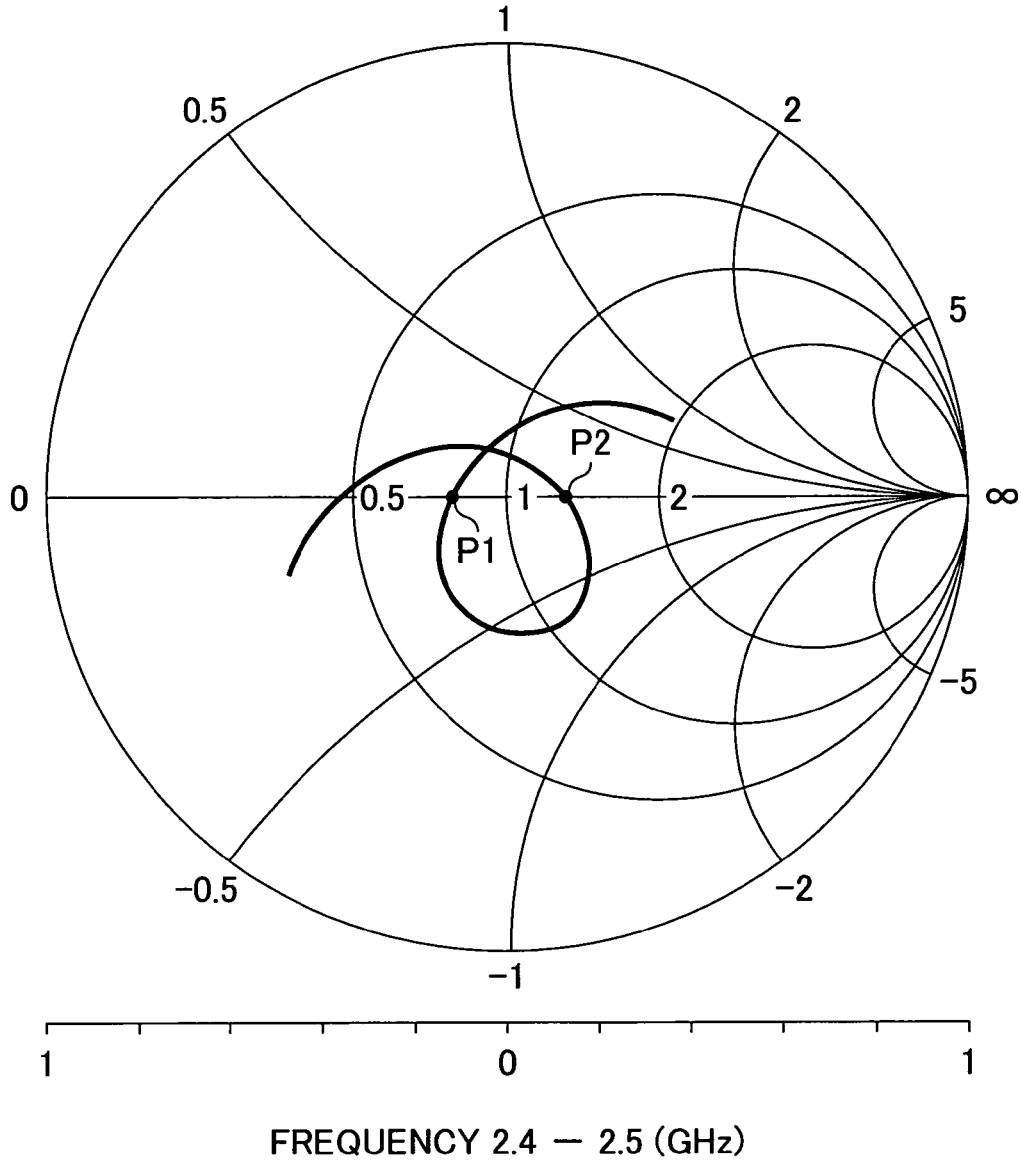
FIG. 8 is a Smith chart obtained as a result of the simulation.

As shown in the Smith chart of FIG. 8, the trajectory followed by the input impedance of the antenna device 1 in the frequency range of 2.4 GHz to 2.5 GHz used for a standard such as wireless LAN or Bluetooth® comes across the central horizontal line twice at points P1 and P2 at which good resonant frequencies are obtained. This shows that the antenna device 1 has two resonant points.

Figure 9:
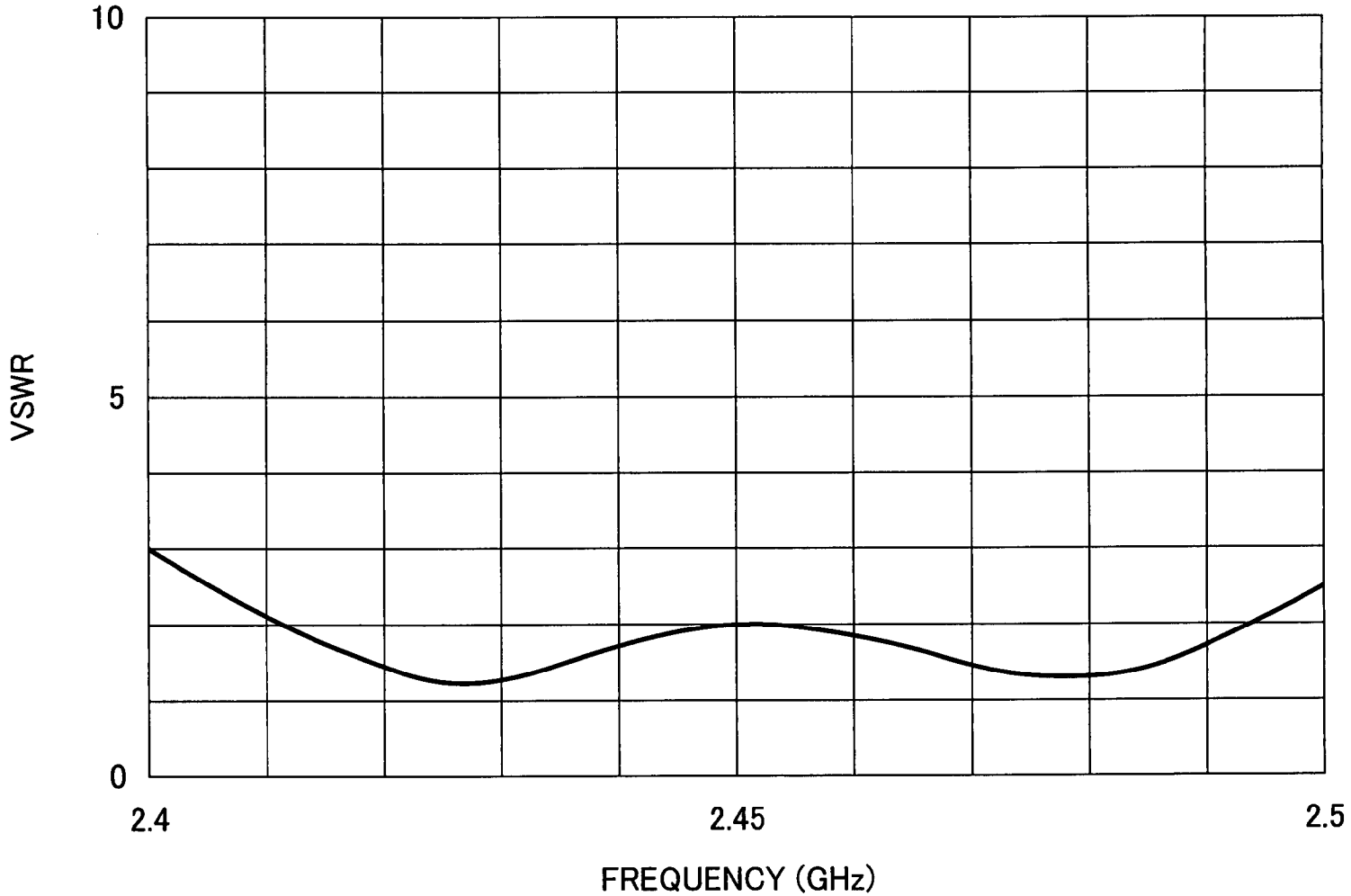
FIG. 9 is a graph showing a VSWR (voltage standing wave ratio) obtained as a result of the simulation.

Further, the VSWR (voltage standing wave ratio) characteristic shown in FIG. 9 clarifies that the frequency range corresponding to a sufficient VSWR falling within a range of 3 or less encompasses the aforementioned frequency bandwidth (100 MHz). In other words, the bandwidth corresponding to the VSWR falling within the range of 3 or less is so secured as to be bandwidth (100 MHz) of 4.1% with respect to the center frequency (2.45 GHz). A general patch antenna has bandwidth of 1% to 2% with respect to the center frequency. Therefore, it is estimated that the antenna device 1 can secure bandwidth more than twice as wide as the general patch antenna does.

Figure 10:
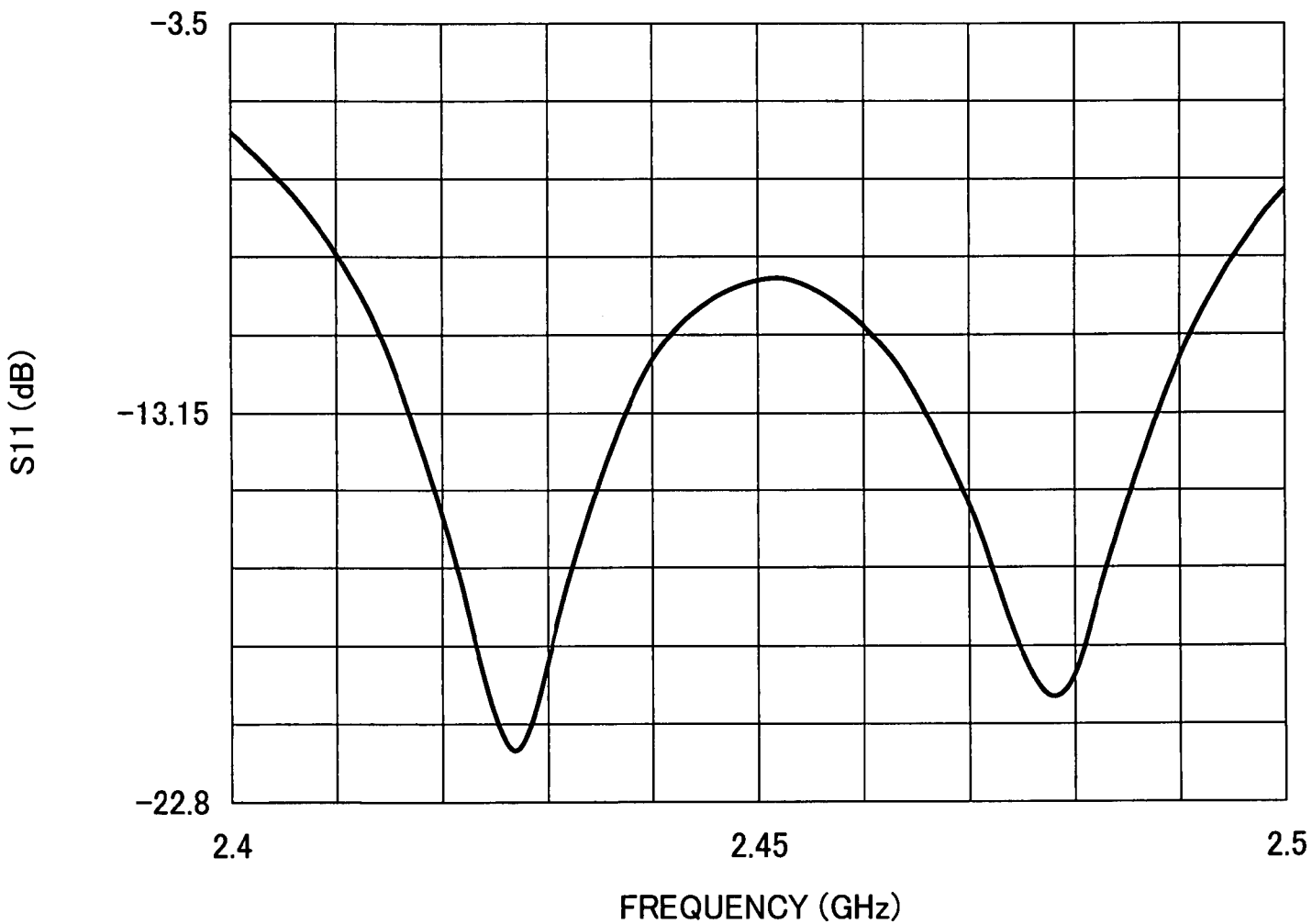
FIG. 10 is a graph showing an S11 characteristic obtained as a result of the simulation.
Figure 11:
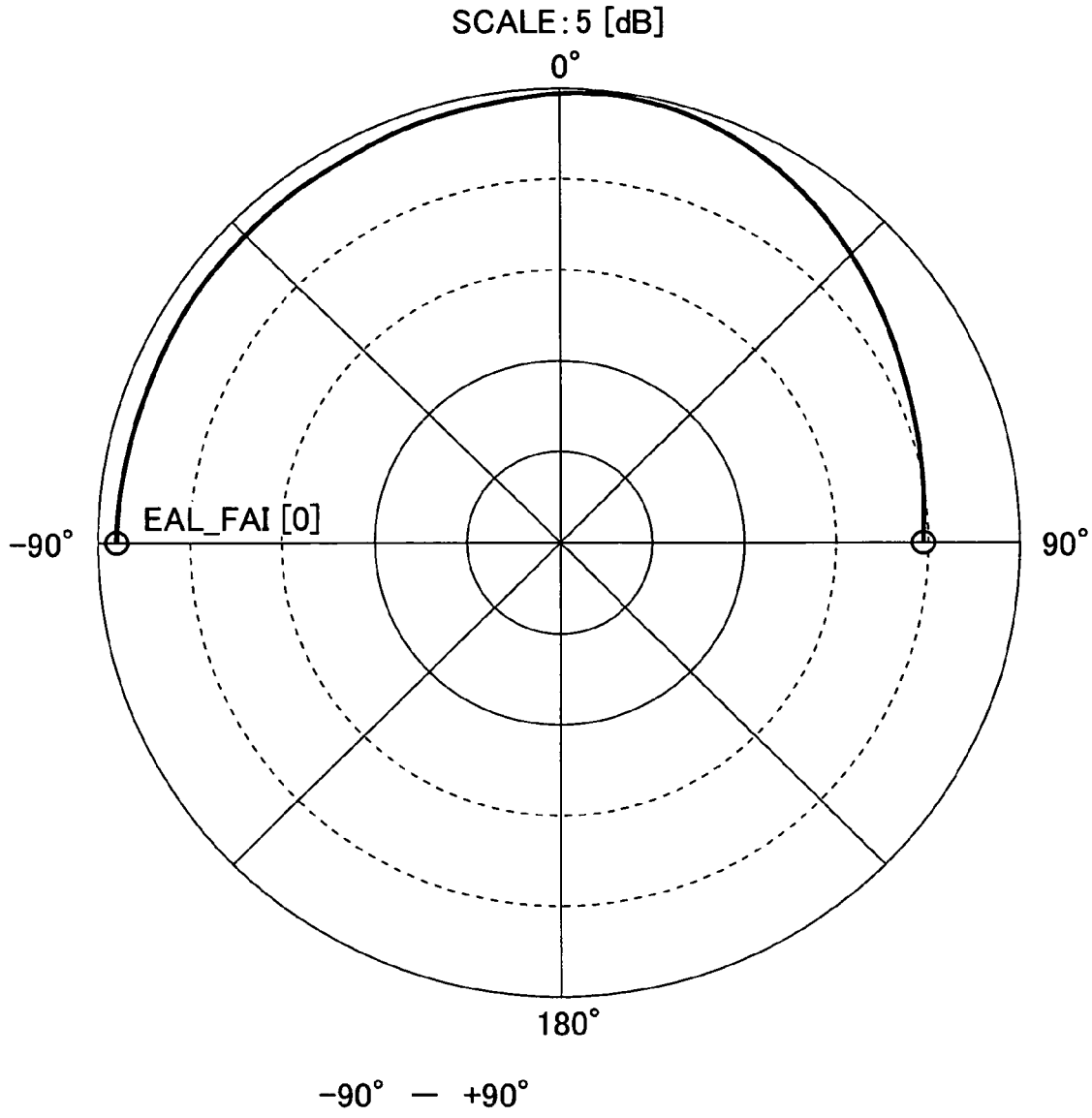
FIG. 11 is a graph showing a directional characteristic of the antenna device which directional characteristic is obtained as a result of the simulation.

FIG. 10 shows a result of estimating the S11 characteristic of an S-parameter. This characteristic shows that there are two frequencies at which the reflection loss decreases within the band, i.e., that there are two resonant frequencies. Further, FIG. 11 shows the directional characteristic of the antenna device 1. FIG. 11 clarifies that the antenna device 1 is estimated to have directivity toward all directions which the antenna elements 3 and 4 face, and that the antenna device 1 exhibits such a substantially uniform directional characteristic.

The antenna device 1 was actually prepared, and the characteristics of the antenna device 1 were measured with the use of a vector network analyzer. As a result, it was confirmed that the bandwidth of 100 MHz is secured in the VSWR falling within the range of 3 or less.

The following explains the results of simulating the characteristics of other antennas each of which serves as a comparative example and each of which is designed to have a resonant frequency of 24.5 GHz.

Firstly, a patch antenna having a patch element with the dimensions 23 mm×23 mm was simulated in the same manner as described above. As a result, the bandwidth was only 35 MHz in the VSWR falling within the range of 3 or less. Further, a patch antenna having a rectangular patch element with the dimensions 72 mm×23 mm was simulated in the same manner as described above. As a result, the bandwidth was 95 MHz in the VSWR falling within the range of 3 or less. However, this patch antenna occupies an area larger than the antenna device 1 illustrated in FIG. 4 does.

Further, an antenna having an arrangement similar to that of the antenna device 1 was also simulated. This antenna is arranged in the following manner. That is, an antenna element similar to the antenna element 3 and an impedance-adjusting microstrip line similar to the transmission line 5 are formed on one surface of a glass substrate (having a thickness of 1.8 mm) with the dimensions 32 mm×12 mm, and a ground plane is formed entirely on the other surface of the glass substrate. In this antenna, an end of the microstrip line serves as a feeding point. The antenna was simulated by varying the shape (size) of the antenna element. As a result, the bandwidth was only 30 MHz in the VSWR falling within the range of 3 or less. This antenna has an area smaller than that of the patch antenna having the patch element with the dimensions 23 mm×23 mm, but realizes bandwidth substantially equal to that of the patch antenna. However, this antenna is insufficient for the acquirement of the bandwidth realized by the antenna device 1.

As described above, the antenna device 1 of the present embodiment is arranged in the following manner. That is, on the surface of the dielectric substrate 2, the planer antenna elements 3 and 4 having different resonant frequencies (center frequencies) are connected to the feeding section 7 via the impedance-adjusting transmission lines 5 and 6, respectively. On the other surface of the dielectric substrate 2, the ground plane 8 is formed. The second element section 32 of the antenna element 3 and the second element section 42 of the antenna element 4 respectively have the ends electrically connected to the ground plane 8. The antenna device 1 having such a structure includes both a patch antenna and an inverted F antenna. The patch antenna is formed using (i) the first element section 31 of the antenna element 3, (ii) the first element section 41 of the antenna element 4, (iii) the dielectric substrate 2, and (iv) the ground plane 8. The inverted F antenna is formed using (a) the first element section 31, (b) the first element section 41, (c) the second element section 32, (d) the second element section 42, and (e) the ground plane 8. With this, the antenna device 1 has a small area, but realizes radiation efficiency equivalent to that of the patch antenna. Further, the antenna elements 3 and 4 having different resonant frequencies are connected respectively to the transmission lines 5 and 6, so that the antenna elements 3 and 4 do not affect each other but operate independently of each other. At the center frequency between the two resonant frequencies, high-frequency currents at the same level flow through the antenna elements 3 and 4, respectively, such that both the antenna elements 3 and 4 function. Therefore, unlike the patch antenna, the antenna device 1 makes it possible to realize both (i) reduction of the area and (ii) widening of the frequency band.

Further, each of the first element sections 31 and 41 is formed so as to take a shape of a rectangle whose longer sides extend in the longitudinal direction of the dielectric substrate 2. Therefore, as illustrated in FIG. 1, the width of the antenna device 1 (dielectric substrate 2) can be reduced. Accordingly, the antenna device 1 can be installed easily in a narrow place in an electronic apparatus.

The present embodiment assumes that each of the antenna elements 3 and 4 has a shape of the inverted L (i.e., is formed such that the first elements sections 31 and 41 are perpendicular respectively to the second element section 32 and 42). However, the shape of each of the antenna elements 3 and 4 is not limited to this. For example, the antenna element 3 may have a shape of a rectangle in which the respective longer sides of the first element section 31 and the second element section 32 extend in the width direction of the dielectric substrate 2. Similarly, the antenna element 4 have a shape of a rectangle in which the respective longer sides of the first element section 41 and the second element section 42 extend in the width direction of the dielectric substrate 2. However, this structure causes the width of the dielectric substrate 2 to become greater. Therefore, the structure illustrated in FIG. 1 is preferable for installation of the antenna device 1 in a smaller place.

The following explains another embodiment of the present invention.

Figure 12:
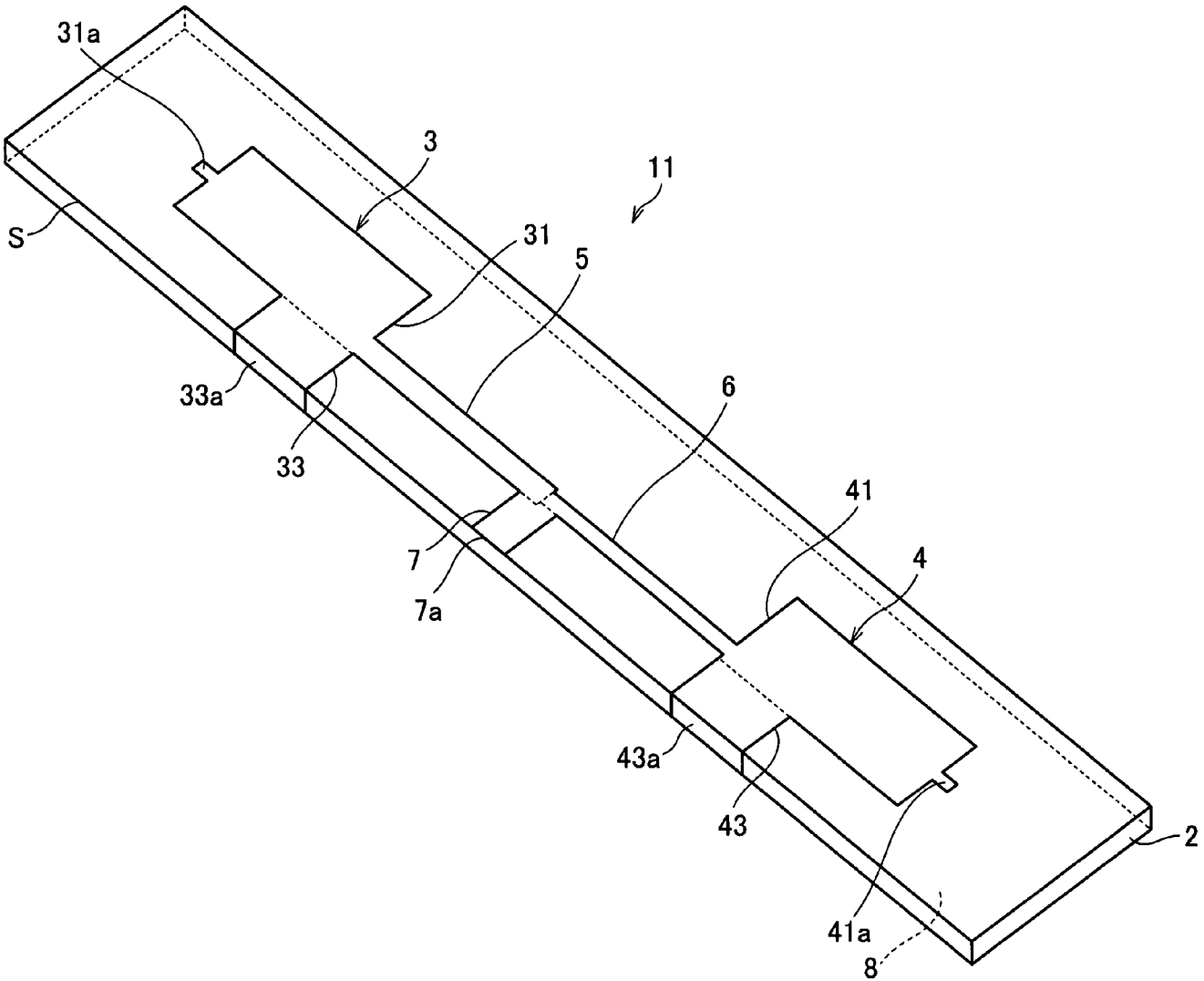
FIG. 12 is a perspective view of a structure of an antenna device according to another embodiment of the present invention.

An antenna device 11 illustrated in FIG. 12 is arranged in the same manner as the antenna device 1, except that: antenna elements 3 and 4 of the antenna device 11 are partially different from those of the antenna device 1, and a dielectric substrate 2 is made of glass and has no through-holes. In the antenna device 11, the antenna element 3 includes a first element section 31 and a second element section 33, and the antenna element 4 includes a first element section 41 and a second element section 43.

Unlike the second element section 32 described above, the second element section 33 includes an electric connecting section 33*a*. Specifically, the electric connecting section 33*a* extends from an end of the second element section 33 to the rear surface of the dielectric substrate 2 via the longer side S and the side end surface of the dielectric substrate 2 so as to be connected to the ground plane 8. Unlike the second element section 42 described above, the second element section 43 includes an electric connecting section 43*a*. Specifically, the electric connecting section 43*a* extends from an end of the second element section 43 to the rear surface of the dielectric substrate 2 via the longer side S and the side end surface of the dielectric substrate 2 so as to be connected to the ground plane 8. Accordingly, the second element section 42 has an electric connecting section 43*a* formed on the side end face of the dielectric substrate 2.

As is the case with the antenna device 1 described above, the antenna device 11 thus arranged was simulated for the antenna characteristics. As a result, it was found that the antenna device 11 can secure the frequency bandwidth used for the standard such as the wireless LAN or the Bluetooth®.

Figure 13:
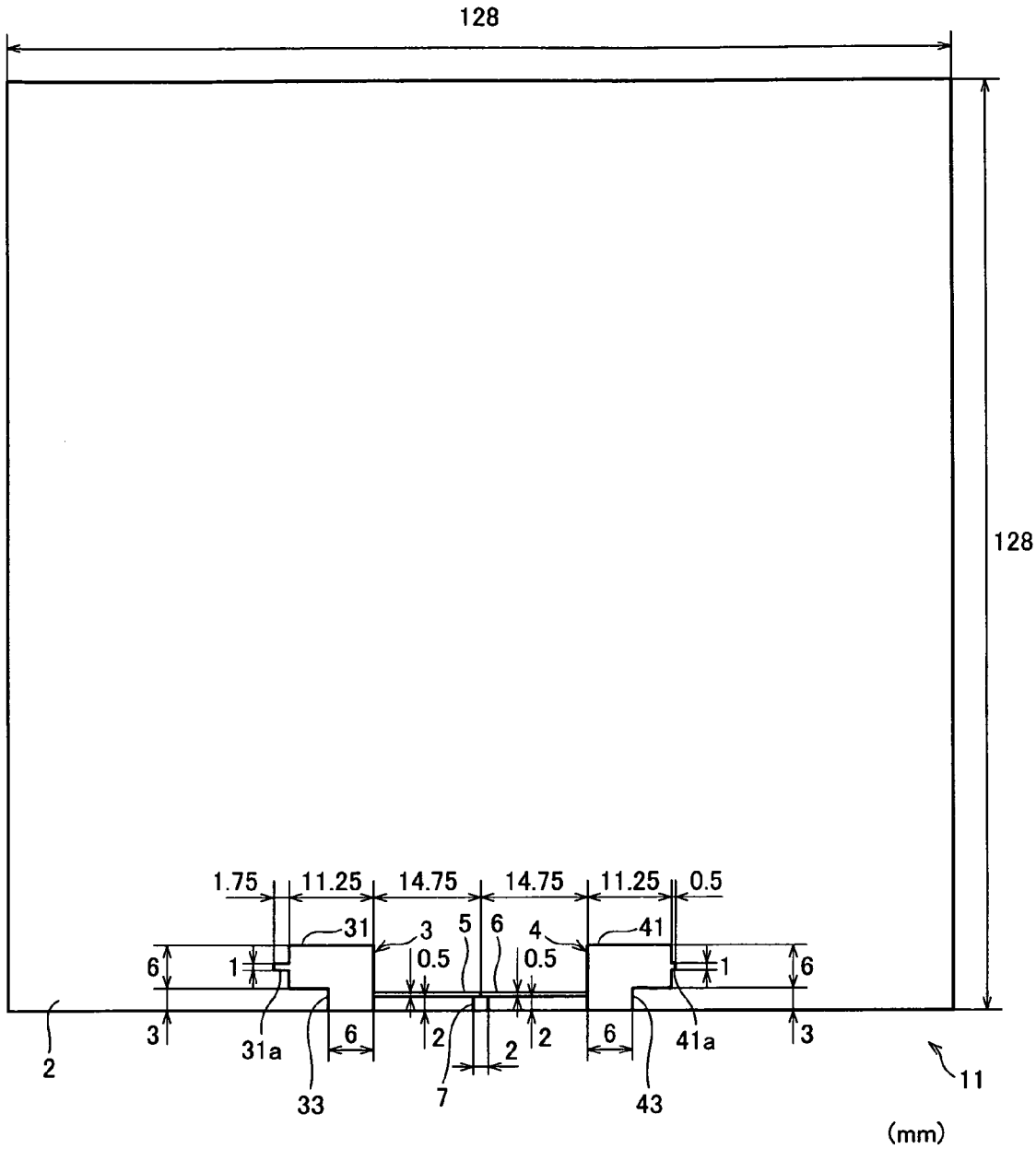
FIG. 13 is a plan view specifying the respective dimensions of components of the antenna device, which is illustrated in FIG. 12, and which is simulated for prediction of its antenna characteristics.

As illustrated in FIG. 13, the dielectric substrate 2 of the antenna device 11 used for the simulation is made of glass (having a relative dielectric constant of 6.91), and can be used also as a glass substrate of a display device. The dimensions of the components are as follows. The dielectric substrate 2 has a length of 128 mm, a width of 128 mm, and a thickness of 1.8 mm. Each of the first element sections 31 and 41 has a length of 11.25 mm and a width of 6 mm. Each of the second element sections 33 and 43 has a length of 3 mm and a width of 6 mm. The frequency adjustment tab 31*a* has a length of 1.75 mm and a width of 1 mm. The frequency adjustment tab 41*a* has a length of 0.5 mm and a width of 1 mm. Each of the transmission lines 5 and 6 has a length of 14.75 mm and a width of 0.5 mm. The feeding section 7 has a length of 2 mm and a width of 2 mm. The other dimensions are shown in FIG. 13.

The following explains an embodiment dealing with an electronic apparatus in which the antenna device 1 or 11 is installed.

Figure 14:
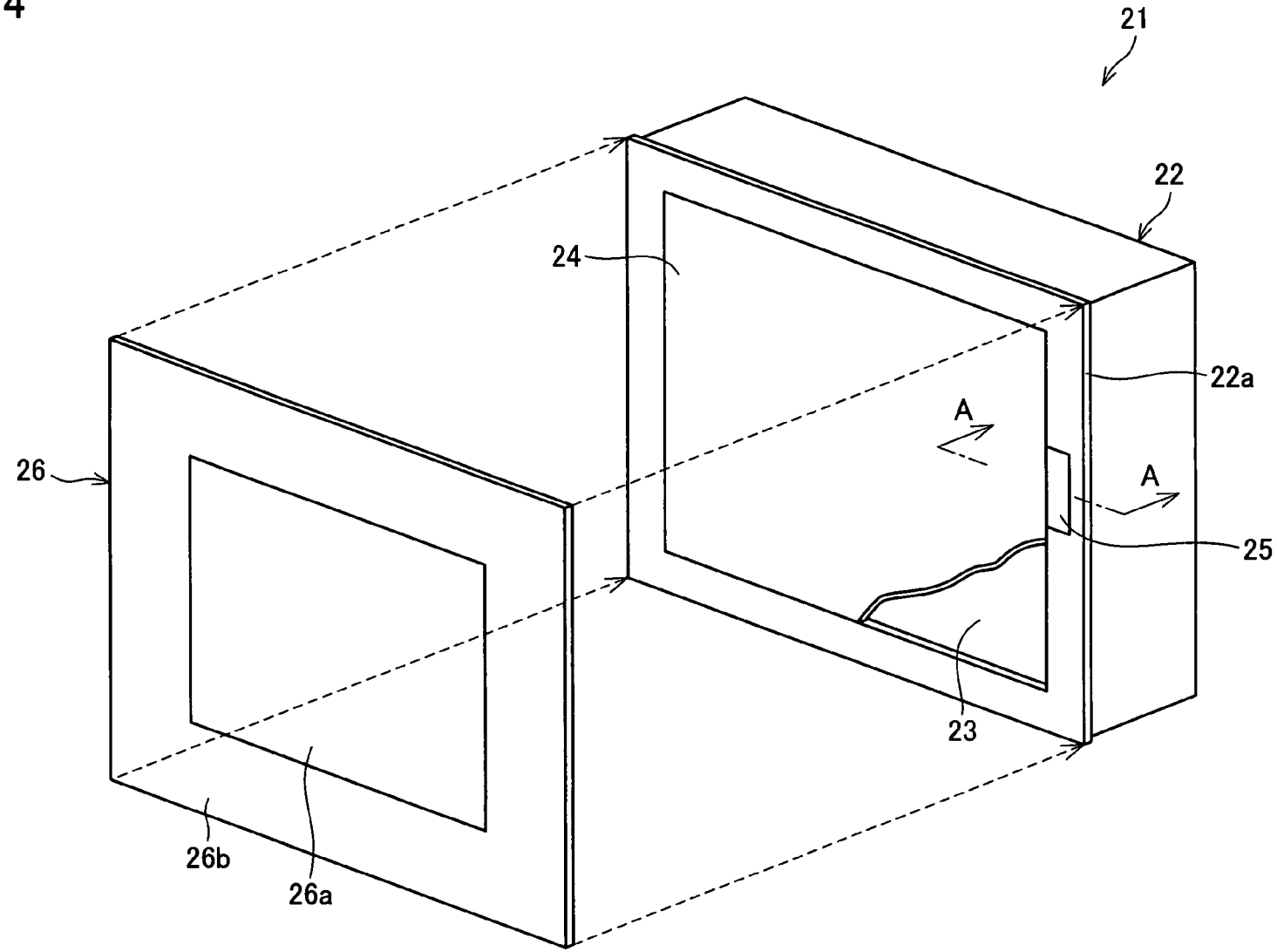
FIG. 14 is an exploded perspective view illustrating an outer structure of a programmable display apparatus according to an embodiment of the present invention.

In the present embodiment, as illustrated in FIG. 14, the antenna device 1 or 11 is installed in a programmable display apparatus 21 so as to serve as an antenna device 25. The programmable display apparatus 21 has an outer structure made up of a case 22, a supporting section 22*a*, and a touch panel 24. The case 22 is provided in the rear portion of the programmable display apparatus 21, and the supporting section 22*a* is provided in the front portion thereof. The touch panel 24 has a rear side over which a display panel 23 is provided. The antenna device 25 is installed in the supporting section 22*a* so as to make contact with the touch panel 24. The display panel 23 is a flat display panel such as a liquid crystal panel, an EL (electroluminescence) panel, or a plasma display panel.

Further, the programmable display apparatus 21 has a front surface in which an overlay 26 is provided so as to cover the supporting section 22*a* and the touch panel 24. The overlay 26 not only protects the touch panel 24, but also serves as a (dust-proof and drip-proof) protective sheet for preventing water, oil, dust, and the like from entering from a gap between the touch panel 24 and the supporting section 22*a* into the case 22. The overlay 26 is made of a resin film (e.g., a polyester film), and includes: (i) a transparent portion 26*a*, which has a shape substantially identical to that of an operation section of the touch panel 24; and (ii) a nontransparent frame portion 26*b*, which is formed so as to surround the transparent portion 26*a*. The frame portion 26*b* has such a size that covers the front surface of the supporting section 22*a* and the front surface of a peripheral portion (frame portion) of the touch panel 24.

Figure 15:
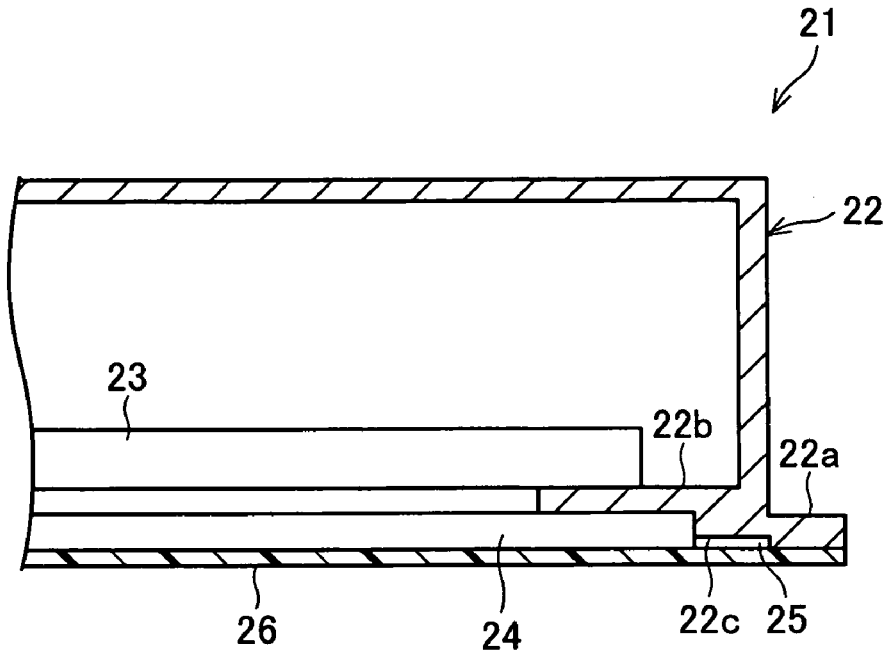
FIG. 15 is a cross-sectional view illustrating a structure of a main part of the programmable display apparatus.

FIG. 15 is a cross-sectional view taken along the line A-A of FIG. 14. As illustrated in FIG. 15, the case 22 is entirely made of metal, and has a front end in which the supporting section 22*a* and a holding section 22*b* are provided. The supporting section 22*a* is so formed as to extend from the side wall of the case 22 inwardly and outwardly with respect to the side wall. Moreover, the supporting section 22*a* extends substantially perpendicularly to the side wall. On the other hand, the holding section 22*b* is so formed as to extend from the side wall inwardly with respect to the side wall. Moreover, the holding section 22*b* extends substantially perpendicularly to the side wall. Further, the position of the holding section 22*b* is closer to the rear wall of the case 22, as compared with the position of the supporting section 22*a* with respect to the rear wall thereof. This allows the touch panel 24 to be held by the front surface of the holding section 22*b*. The peripheral portion of the touch panel 24 is fixed to the front portion of the holding section 22*b* by an adhesive material such that the touch penal 24 is held by the holding section 22*b*. Further, the display panel 23 has a peripheral portion fixed to the rear portion of the holding section 22*b* with the use of the adhesive material, so as to be held by the holding section 22*b*.

The antenna device 25 is installed so as to engage with a depressed portion 22*c* formed on the front surface of the supporting section 22*a*. Further, the supporting section 22*a* is provided with a hole (not shown) through which a coaxial cable is inserted so as to connect the antenna device 25 to a transmitting/receiving circuit provided in the case 22.

In the programmable display apparatus 21 thus arranged, a ground plane is formed on the rear surface of the antenna device 25, so that the antenna device 25 operates properly even when installed in the case 22, i.e., in a metal case. Further, the antenna device 25 has a narrow width, and therefore can be installed easily in a narrow place in the supporting section 22*a*.

The present embodiment assumes that the programmable display apparatus 21 is an electronic apparatus in which the antenna device 1 or 11 is installed. However, the electronic apparatus having the antenna device 1 or 11 installed therein may not be the programmable display apparatus 21 as long as the electronic apparatus has a metal case and a wireless communication function.

As described above, an antenna device according to the present embodiment is arranged in the following manner. That is, on one surface of a dielectric substrate, a pair of antenna elements having different resonant frequencies are connected to a feeding section by impedance-adjusting transmission lines, respectively. On the other surface of the dielectric substrate, a ground plane is formed. The antenna elements respectively have ends electrically connected to the ground plane. Accordingly, unlike the patch antenna, the antenna device makes it possible to realize both (i) reduction of the area and (ii) widening of the frequency band. Therefore, the antenna device according to the present embodiment can be applied suitably to an electronic apparatus that carries out communication in accordance with a communication method, such as wireless LAN, which requires a wide band.

The antenna device is preferably arranged such that each of the antenna elements has a peripheral portion in which a current path adjustment section is so provided as to have such a shape that a current path through which a high-frequency current flows becomes longer. The high-frequency current flows in accordance with the skin effect, i.e., flows near an edge portion of a conductor instead of flowing through a central portion of the conductor. Therefore, the current path through which the high-frequency current flows can be shortened with the use of the current path adjustment section such that the resonant frequency of the antenna element can be adjusted. The current path adjustment section is preferably a protrusion or a notch (depressed portion), for example. Such a protrusion or such a notch can be formed so as to be smaller than the antenna element. Therefore, the resonant frequency can be adjusted more finely and more subtly by changing the perimeter of the protrusion or the perimeter of the notch than by changing the perimeter of the antenna element.

The antenna device is preferably arranged such that the antenna element has a portion having a rectangular shape whose longer sides extend in a longitudinal direction of the dielectric substrate. This causes the antenna element to occupy a smaller area in a width direction of the dielectric substrate such that the width of the dielectric substrate can be narrowed. This causes the width of the entire antenna device to be narrower such that the antenna device can be installed easily in a narrow place.

The antenna device preferably has a center frequency of 2.45 GHz. This makes it possible to provide a small-size wideband antenna device that operates in compliance with a standard such as the wireless LAN.

An electronic apparatus of the present embodiment includes a metal case in which the antenna devices according to any one of the foregoing arrangements is installed.

With this, a ground plane is formed on the rear surface of the antenna device so that the antenna device operates properly even when installed in the metal case.

The present invention is not limited to the description of the embodiments above, but may be altered by a skilled person within the scope of the claims. An embodiment based on a proper combination of technical means disclosed in different embodiments is encompassed in the technical scope of the present invention.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An antenna device, comprising:

a dielectric substrate;

a ground plane, which is formed on a surface of the dielectric substrate;

a pair of antenna elements, which are flat and which have different resonant frequencies and which are formed on another surface of the dielectric substrate and which respectively have ends electrically connected to the ground plane;

a feeding section for feeding power to each of the antenna elements; and a pair of transmission lines, which are connected respectively to the antenna elements and which carry out impedance conversion such that parts of the transmission lines which are connected to the antenna elements have impedances matching input impedances of the antenna elements, respectively, and such that part of the feeding section which is fed with the power has an impedance matching an impedance of the feeding section, wherein each antenna element includes first and second rectangular sections, the second rectangular sections being adjacent to the first rectangular sections, the first and second rectangular sections forming an L-shape, the second rectangular sections being electrically connected to the ground plane via through holes.

2. The antenna device as set forth in claim 1, wherein each of the antenna elements has a peripheral portion in which a current path adjustment section is so provided as to have such a shape that a current path through which a high frequency current flows becomes long.

3. The antenna device as set forth in claim 2, wherein the current path adjustment section is a frequency adjustment tab.

4. The antenna device as set forth in claim 2, wherein the current path adjustment section is a frequency adjustment notch.

5. The antenna device as set forth in claim 1, wherein each of the antenna elements has a portion having a rectangular shape whose longer sides extend in a longitudinal direction of the dielectric substrate.

6. The antenna device as set forth in claim 1, said antenna device having a center frequency of 2.45 GHz.

7. An electronic apparatus, comprising:

a metal case; and an antenna device, installed in the metal case, the antenna device, including:

a dielectric substrate;

a ground plane, which is formed on a surface of the dielectric substrate;

a pair of antenna elements, which are flat and which have different resonant frequencies and which are formed on another surface of the dielectric substrate and which respectively have ends electrically connected to the ground plane;

a feeding section for feeding power to each of the antenna elements; and a pair of transmission lines, which are connected respectively to the antenna elements and which carry out impedance conversion such that parts of the transmission lines which are connected to the antenna elements have impedances matching input impedances of the antenna elements, respectively, and such that part of the feeding section which is fed with the power has an impedance matching an impedance of the feeding sections, wherein each antenna element includes first and second rectangular sections, the second rectangular sections being adjacent to the first rectangular sections, the first and second rectangular sections forming an L-shape, the second rectangular sections being electrically connected to the ground plane via through holes.

8. The electronic apparatus as set forth in claim 7, wherein each of the antenna elements has a peripheral portion in which a current path adjustment section is so provided as to have such a shape that a current path through which a high frequency current flows becomes long.

9. The electronic apparatus as set forth in claim 8, wherein the current path adjustment section is a frequency adjustment tab.

10. The electronic apparatus as set forth in claim 8, wherein the current path adjustment section is a frequency adjustment notch.

11. The electronic apparatus as set forth in claim 7, wherein each of the antenna elements has a portion having a rectangular shape whose longer sides extend in a longitudinal direction of the dielectric substrate.

12. The antenna device as set forth in claim 7, said antenna device having a center frequency of 2.45 GHz.

* * * * *